US012409990B2

(12) United States Patent
Bouteloup et al.

(10) Patent No.: US 12,409,990 B2
(45) Date of Patent: Sep. 9, 2025

(54) CAPSULE ADAPTED TO RECEIVE A FLUID, AND ASSEMBLY COMPRISING A CONTAINER AND SAID CAPSULE

(71) Applicant: CORADIN SAS, Mouans-Sartoux (FR)

(72) Inventors: David Bouteloup, Peymeinade (FR); Fabrice Bourdier, Montauroux (FR); Florence Bidamant, Mulhouse (FR)

(73) Assignee: CORADIN SAS, Mouans-Sartoux (FR)

( * ) Notice: Subject to any disclaimer, the term of this patent is extended or adjusted under 35 U.S.C. 154(b) by 319 days.

(21) Appl. No.: 17/474,150

(22) Filed: Sep. 14, 2021

(65) Prior Publication Data

US 2022/0063880 A1 Mar. 3, 2022

Related U.S. Application Data

(63) Continuation of application No. PCT/FR2020/050576, filed on Mar. 17, 2020.

(30) Foreign Application Priority Data

Mar. 22, 2019 (FR) ..... 1903024

(51) Int. Cl.
*B65D 51/28* (2006.01)
*B65D 81/32* (2006.01)

(52) U.S. Cl.
CPC ..... *B65D 51/2821* (2013.01); *B65D 81/3222* (2013.01)

(58) Field of Classification Search
CPC ..... B65D 51/2821; B65D 81/3222
See application file for complete search history.

(56) References Cited

U.S. PATENT DOCUMENTS 3,156,369 A * 11/1964 Bowes ..... B65D 51/285 215/250
4,201,316 A * 5/1980 Klingaman ..... B65D 51/2835 222/80

(Continued)

FOREIGN PATENT DOCUMENTS

CN 101941552 A 1/2011
DE 10 2005 008238 A1 8/2006

(Continued)

OTHER PUBLICATIONS

International Search Report and Written Opinion for Application No. PCT/FR2020/050575 dated Jun. 18, 2020.

(Continued)

*Primary Examiner* — Tri M Mai
(74) *Attorney, Agent, or Firm* — Jenkins, Taylor & Hunt, P.A.

(57) ABSTRACT

A capsule to seal the opening in a container, such as the neck of a bottle, wherein the container is adapted to contain a first fluid, the capsule being adapted to contain a second fluid that is different from the first fluid, the capsule including a striker movable from a first initial position to a second opening position and which, in the second position, allows the second fluid to be released into the container, thus mixing the first fluid and the second fluid, the striker being in the form of a cylinder adapted to allow a fluid discharge device, such as a pipette, to pass through the capsule and to enter the container.

3 Claims, 8 Drawing Sheets

(56) References Cited

U.S. PATENT DOCUMENTS

| | | | | |
|---|---|---|---|---|
| 4,682,689 | A | 7/1987 | Pereira et al. | |
| 4,982,875 | A | 1/1991 | Pozzi et al. | |
| 5,421,483 | A * | 6/1995 | Parise | B05B 11/0078 222/129 |
| 6,041,969 | A * | 3/2000 | Parise | B05B 11/0078 222/129 |
| 6,116,445 | A * | 9/2000 | Ikemori | B65D 51/225 220/267 |
| 6,148,996 | A * | 11/2000 | Morini | B65D 51/285 215/DIG. 8 |
| 6,997,351 | B2 * | 2/2006 | Cho | B65D 51/2835 222/83.5 |
| 7,219,796 | B2 * | 5/2007 | Anderson | B65D 51/2842 206/219 |
| 8,387,786 | B2 * | 3/2013 | Fontana | B65D 51/2892 215/DIG. 8 |
| 8,413,802 | B2 | 4/2013 | Lee et al. | |
| 8,701,906 | B1 | 4/2014 | Anderson | |
| 8,714,808 | B2 * | 5/2014 | Yamanaka | B65D 51/2821 366/130 |
| 10,940,983 | B2 * | 3/2021 | Paganuzzi | B65D 51/2842 |
| 12,358,700 | B2 | 7/2025 | Bouteloup et al. | |
| 2007/0170142 | A1 | 7/2007 | Cho | |
| 2008/0093326 | A1 * | 4/2008 | Cho | B65D 51/285 206/222 |
| 2009/0184083 | A1 * | 7/2009 | Cho | B65D 47/06 215/388 |
| 2022/0063881 | A1 | 3/2022 | Bouteloup et al. | |

FOREIGN PATENT DOCUMENTS

| | | | |
|---|---|---|---|
| EP | 2 700589 | A2 | 2/2014 |
| WO | WO 98/38104 | A1 | 9/1998 |
| WO | WO 2006/111803 | A2 | 10/2006 |
| WO | WO 2007/006414 | A1 | 1/2007 |
| WO | WO 2008/036889 | A2 | 3/2008 |
| WO | WO 2008/051032 | A1 | 5/2008 |
| WO | WO 2009/031864 | A1 | 3/2009 |
| WO | WO 2009/073998 | A1 | 6/2009 |
| WO | WO 2010/143617 | A1 | 12/2010 |
| WO | WO 2020/193917 | A1 | 10/2020 |
| WO | WO 2020/193918 | A1 | 10/2020 |

OTHER PUBLICATIONS

International Search Report and Written Opinion for Application No. PCT/FR2020/050576 dated Jun. 18, 2020.
Restriction Requirement for U.S. Appl. No. 17/474,180 (Sep. 7, 2023).
First Examination for European Patent Application 20 726 225.4 (Mar. 20, 2023).
Non-Final Office Action for U.S. Appl. No. 17/474,180 (Dec. 6, 2023).
Final Office Action for U.S. Appl No. 17/474,180 (Apr. 12, 2024).
Non-Final Office Action for U.S. Appl. No. 17/474,180 (Oct. 21, 2024).
Notice of Allowance for U.S. Appl. No. 17/474,180 (Mar. 12, 2025).
Advisory Action for U.S. Appl. No. 17/474,180 (Jun. 24, 2024).
Office Action for European Patent Application Serial No. 20 726 225.4 (Apr. 10, 2025).

* cited by examiner

CAPSULE ADAPTED TO RECEIVE A FLUID, AND ASSEMBLY COMPRISING A CONTAINER AND SAID CAPSULE

CROSS-REFERENCE TO RELATED APPLICATIONS

This application is a continuation of and claims priority to PCT/EPFR2020/050576 filed Mar. 17, 2020 which claims priority to French Patent Application No. 1903024 filed Mar. 22, 2019, the entire disclosures of which are incorporated by reference herein.

TECHNICAL FIELD

The invention relates to a capsule adapted to seal the opening in a container, such as the neck of a bottle, wherein said container is adapted to contain a first fluid, the capsule being, for its part, adapted to contain a second fluid which is different from said first fluid.

The capsule according to the present invention is provided with a space intended for receiving at least one second fluid, which is different from the first fluid. The invention also relates to the assembly made up of a container, which is adapted to package a first fluid, and a capsule according to the invention.

BACKGROUND

Capsules which are adapted to provide a space that is intended to contain a second fluid have already been disclosed in the prior art, said capsules being adapted to seal a container envisaged for containing a first fluid. At a moment determined by the user, the contents of the capsule, namely the second fluid contained in said capsule, can be released in order to mix with the first fluid that is present in the container. An example of a capsule of this type is described in U.S. Pat. No. 8,413,802. This type of capsule can prove to be useful for mixing a first and a second fluid, just before the container is first opened, in order to ensure that said first fluid and said second fluid are freshly mixed before said mixture is expelled from the container. Another option for this type of capsule consists of offering the user the choice of mixing or not mixing the contents of the capsule, i.e. the second fluid, with the first fluid contained in the container.

The capsules disclosed in the state of the art exhibit a special characteristic according to which, if said capsule is removed from the container in order to be opened, the space intended for containing the second fluid is removed from said container at the same time. A first disadvantage results from the fact that if the mechanism which lets the second fluid be mixed with the first fluid, which is present in the container, has been used before, the space intended for accommodating the second fluid has already been opened. By taking the capsule out of the container, the rest of said second fluid can possibly remain, in a pure state, accessible for the user. If the second fluid is particularly acidic or corrosive, contact with the second fluid, in a pure state, can pose a risk for the user.

Moreover, by removing the space intended for receiving the second fluid, when the capsule according to the prior art is removed from the container, the side of the space, which is adapted for receiving said second fluid, in a position in which the capsule is orientated towards the interior of the container, is exposed and can be in contact with any type of contamination. Consequently, after a potentially contaminated capsule is repositioned, the purity of the mixture of the first and the second fluid inside the container can be seriously compromised.

Another disadvantage of the capsule disclosed in the prior art is the fact that it does not provide any support to a fluid extraction device such as a pipette. In the event that the first fluid and the second fluid to be packaged in the assembly made up of the device and the capsule are pharmaceutical products or cosmetics, it can be advantageous to use a pipette in order to extract the first fluid and/or the mixture of the first and the second fluid from the interior of the container to the exterior.

With regard to the observations above, it appears that there is a need to improve the existing containers which are intended to contain a first fluid and which can cooperate with a capsule adapted to pour a second fluid and mix it with said first fluid.

SUMMARY

The subject of the invention is a capsule adapted to seal the opening in a container, such as the neck of a bottle, wherein said container is adapted to contain a first fluid, the capsule being adapted to contain a second fluid that is different from said first fluid, said capsule comprising a striker which is movable from a first initial position to a second opening position and which, in said second position, allows said second fluid to be released into the container, thus mixing the first fluid and the second fluid, said striker being in the form of a cylinder adapted to allow a fluid discharge device, such as a pipette, to pass through the capsule and to enter the container.

According to one embodiment of the invention, said capsule comprises fixing structure(s), such as a rib, for fixing the capsule in the opening in the container.

According to one embodiment of the invention, said capsule, in the use position of said capsule, on the side exposed towards the interior of the container, is delimited by a first protective cover, wherein the striker is adapted, in its second opening position, to open said protective cover.

According to one embodiment of the invention, the striker comprises, in the use position of said capsule, at the end directed towards the exterior of the container, a transverse wall adapted to cooperate with a push-piece which thus allows said striker to be moved forward from its initial position to its opening position.

According to one embodiment of the invention, said transverse wall comprises at least part of the outer wall of said capsule, in its use position.

According to one embodiment of the invention, the wall of said capsule exposed towards the exterior of the container, in the use position of the capsule, is made of a flexible material on which the striker is fixed.

According to one embodiment of the invention, the striker in the use position of the capsule, on the side exposed towards the exterior of the container, is sealed with the aid of a second protective cover.

According to one embodiment of the invention, said second protective cover is adapted to be struck with the aid of a fluid discharge device such as a pipette.

According to one embodiment of the invention, said second protective cover is adapted to be taken off.

According to one embodiment of the invention, the first protective cover comprises a material which is impermeable to oxygen, such as aluminum.

The present invention also relates to an assembly comprising a container, adapted to contain a first fluid, with an opening which allows said container to be filled and emptied, a lid adapted to seal said opening and a capsule described above, wherein the container is provided with fixing structure such as a thread which allows said lid to be fixed onto the container, wherein the interior of said lid is provided with at least one first push-piece adapted to push the capsule towards the interior of the opening in the container, thus fixing said capsule in said opening.

According to one embodiment of the invention, the interior of the lid is provided with at least one second push-piece adapted to cooperate with the transverse wall of the striker, thus allowing said striker to be moved forward from its first initial position to its second opening position.

BRIEF DESCRIPTION OF THE DRAWINGS

The aim, subject and characteristics of the invention will become more clearly apparent on reading the following description with reference to the figures, in which.

DETAILED DESCRIPTION

Figure 1:
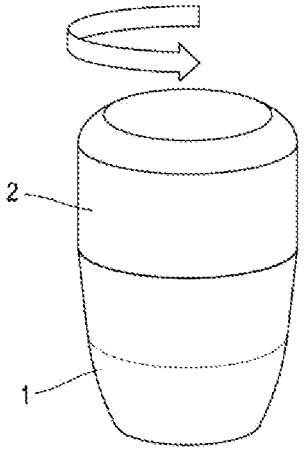
FIG. 1 shows a container adapted to cooperate with the capsule according to the invention, said container being provided with a protection member.
Figure 2:
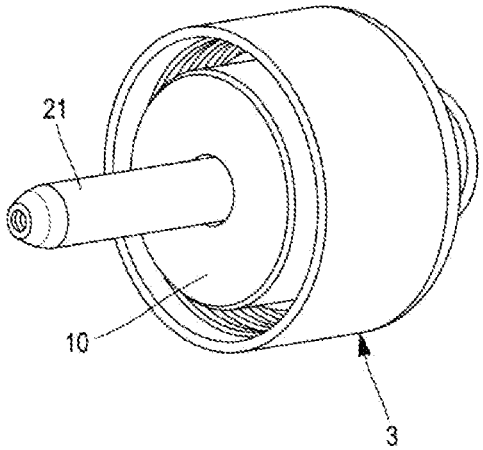
FIG. 2 depicts a pipette lid adapted to be fixed onto the container according to FIG. 1.

FIG. 1 shows a container 1 adapted to cooperate with the capsule according to the present invention. According to FIG. 1, the container 1 is provided with a protection member 2 which must be taken off before said container 1 is used. Once the protection member 2 has been taken off, a pipette lid 3, as shown in FIG. 2, can be fixed on said container 1. The interior of the pipette lid 3 comprises a capsule 10 according to the present invention. During the first fixing of the pipette lid 3 onto the container 1, the capsule 10 is simultaneously introduced into the interior of said container 1. As described in more detail below, the capsule 10 is adapted to seal the opening in the container 1 and is provided with fixing structure(s) which allow it to be held once it is introduced into the container 1. In other words, the capsule 10 is transferred from the pipette lid 3 to the container 1 during its first fixing onto the container 1.

Figure 3:
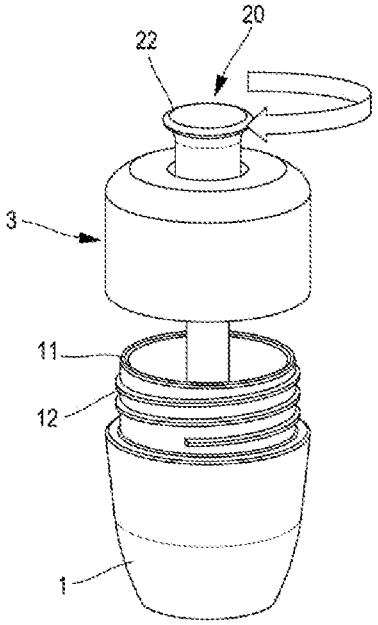
FIG. 3 illustrates the fixing, by screwing, of the pipette lid, according to FIG. 2, onto the container according to FIG. 1.

The fixing of the pipette lid 3 onto the container 1 is depicted in FIG. 3. Firstly, the pipette lid 3 is positioned on the upper edge 11 of said container 1. A thread 12 present on the exterior of the container 1 can then be used, in combination with a thread present inside the pipette lid 3 (as shown in FIG. 2), to screw said pipette lid 3 onto the container 1. During this screwing step, as explained above, the capsule 10 is fixed inside the container 1 next to the upper edge 11 of said container 1.

As illustrated in FIGS. 2 and 3, the pipette lid 3 is provided with an integral pipette 20, which pipette 20 is provided with a rod 21 adapted to enter into the container 1. The pipette 20 is also provided with a head 22 which allows the user to take a sample of a specific quantity of product present inside the container 1.

Figure 4:
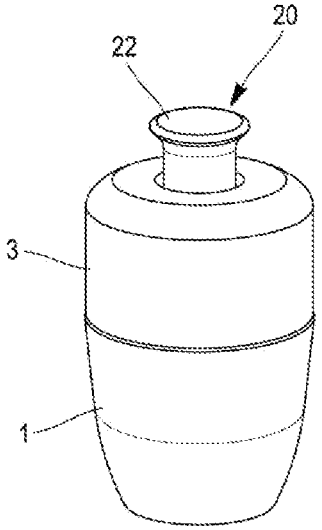
FIG. 4 shows the pipette lid fixed on the container after the screwing step, as shown in FIG. 2.
Figure 5:
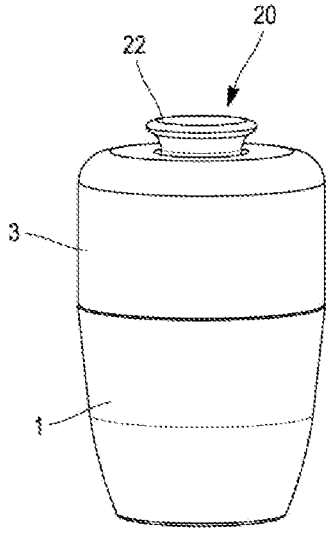
FIG. 5 depicts a diagrammatic view of the sampling of a specific quantity of fluid, contained within the container, with the aid of the pipette, said pipette forming an integral part of the pipette lid.
Figure 6:
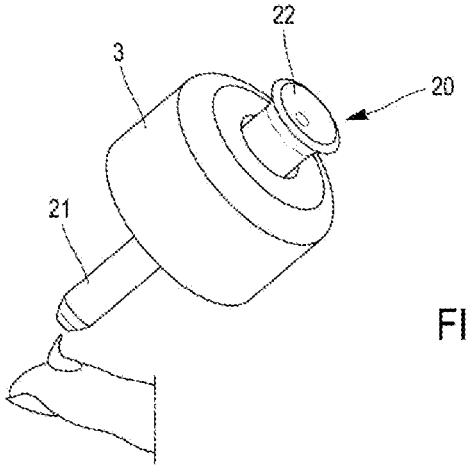
FIG. 6 illustrates the sample return step performed with the aid of the pipette, said pipette forming an integral part of the pipette lid.

FIG. 4 illustrates the pipette lid 3 fixed on the container 1. As depicted in FIG. 4, the user has direct access to the head 22 of the pipette 20 which can lower a plunger 24 (see FIG. 7) of the pipette 20, from its position as shown in FIG. 4 in the direction of the position as shown in FIG. 5. When the plunger 24 is pushed in, the user can let go of the head 22 of said pipette 20 so that it again takes up the position as illustrated in FIG. 4. This movement allows the pipette 20 to be filled with a specific quantity of fluid. After the pipette 20 is filled, the user can unscrew the pipette lid 3 and allow the return of the sampling performed by pressure on the head 22 of the pipette 20. FIG. 6 offers a diagrammatic illustration of the return of a quantity of fluid.

According to the examples illustrated in FIGS. 4, 5 and 6, the plunger 24 of the pipette 20 can be displaced by approximately 5 to 10 millimetres between the initial position depicted in FIG. 4 and the final position depicted in FIG. 5. According to the example illustrated in FIGS. 1 to 12, such a displacement corresponds to a quantity of fluid of approximately 1 to 2 ml sampled from the container. This indicates that the user has, after a sampling, a specific and relatively limited quantity in the pipette 20 before the return of said limited quantity. An overdosage of fluid is thus ensured with the aid of said pipette 20. It should be understood that a larger or smaller displacement is possible depending on the user's specific needs and the characteristics of the fluid to be sampled in the container 1.

The examples depicted in FIGS. 7 to 12 illustrate, in a more detailed manner, the functioning of the device described above.

Figure 7:
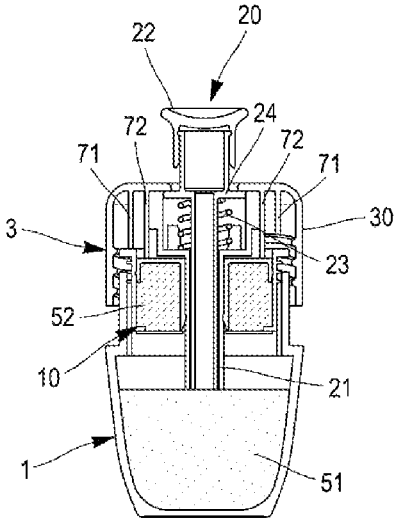
FIG. 7 shows a sectional view of the fixing of the pipette lid on the container according to FIG. 3.

FIG. 7 depicts a sectional view of the assembly made up of the container 1 and the pipette lid 3. FIG. 7 illustrates a first screwing of the pipette lid 3 onto the container 1. Firstly, the capsule 10 situated inside the body 30 of the pipette lid 3 comes into contact with the container 1 next to the edge 11, which is illustrated in detail in FIG. 8. The capsule 10 is provided with an assembly of ribs 41, 42, 43 which have the purpose of coming into contact with the inner wall of the container 1 next to the edge 11. The elastic deformation of said ribs 41, 42, 43 ensures a force which allows the capsule 10 to be fixed inside the container 1. The vertical movement of said capsule 10 towards the interior of the container 1 is limited by the stop 44 adapted to come into contact with the edge 11 during the entry of the capsule 10 into the container 1. The first fixing of the pipette lid 3 onto the container 1 is ensured with the aid of screwing, which is performed with the aid of the threads present on the interior of the body 30 of the pipette lid 3 on the one hand and, on the other hand, on the exterior of the container 1, below the edge 11. By screwing the pipette lid 3 onto the container 1, the capsule 10 located inside the body 30 of the pipette lid 3 is fixed inside the container 10, as is described above.

The pipette lid 3 is provided with a pipette 20 which forms an integral part of said pipette lid 3. The pipette 20 is provided with a head 22 adapted to exert pressure which makes it possible to push in a plunger 24 relative to the body 30 in a rod 21. When the force of pressure ceases, the pipette 20 takes up its initial position again by virtue of the presence of a spring 23. The pipette 20 comprises a rod 21 which is adapted to extend inside the container 1 in order to come into contact with a fluid 51 present inside said container 1. The rod 21 is connected to the material of the body 30 and remains immobile relative to said body 30. The plunger 24 functions as a movable sampling member inside the rod 21. The plunger 24 can be displaced relative to said rod 21 by virtue of the pressure exerted onto the head 22 of the pipette 20. The spring 23 is situated between the rod 21 and the plunger 24, thus allowing, by virtue of the movement of said plunger 24 relative to said rod 21, the sampling of a specific quantity of fluid with the aid of the pipette 20.

Before the pipette lid 3 is mounted on the container 1, as depicted in FIGS. 2 and 7, the capsule 10 present inside the body 30 of the lid 3 is held in place with the aid of a friction force exerted by the interior of the capsule 10 onto the exterior of the rod 21. Said friction force is, on the one hand, sufficient to avoid any involuntary displacement of the capsule 10 relative to the rod 22 and, on the other hand, is sufficiently limited to allow the movement of the rod 21 relative to the capsule 10 once said capsule 10 is correctly fixed inside the container 1.

Figure 8:
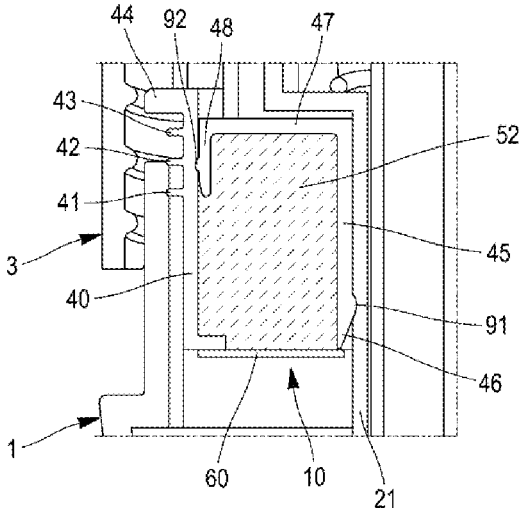
FIG. 8 depicts a detailed view of the contact between the upper edge of the container, the body of the pipette lid and the capsule, during the step of fixing said pipette lid onto said container.

The capsule 10 has three members which together form a space adapted to contain a second fluid 52 inside said capsule 10. With reference to FIG. 8, the member is in the form of a cylindrical body 40, representing the outer wall of the capsule 10. As described above, the cylindrical body 40 is provided with ribs 41, 42, 43 and a stop 44. In the position as depicted in FIG. 8, the cylindrical body 40 is open at its lower end, which lower end is sealed by a protective cover 60, the protective cover 60 being the second member which forms the space adapted to contain the second fluid 52.

The third member of the capsule 10 is formed by a cylindrical member 45, which acts as a striker. The lower part of said striker 45, i.e. the part directed towards the interior of the container 1 after assembling, is provided with a sharp end 46 adapted to perforate the protective cover 60, thus releasing the second fluid 52. The striker 45 is, at its upper end, i.e. the end directed towards the exterior of the container 1 after assembling, connected to a transverse wall 47 forming the upper wall of the capsule 10. The transverse wall 47 is provided, at its outer end, with a sealing grommet 48 adapted to come into contact with the inner walls of the cylindrical body 40. The sealing grommet 48 exerts onto the interior of the cylindrical body 40 a force sufficient to guarantee the seal between said cylindrical body 40 and said sealing grommet 48. However, the friction force between the cylindrical body 40 and the sealing grommet 48 allows the assembly made up of the striker 45, the transverse member 47 and the sealing grommet 48 to be displaced relative to the cylindrical body 40, once a sufficient force is exerted onto the transverse wall 47.

The lower end of the striker 45 is provided with a member 46 adapted to strike the protective cover 60. It should be noted that said striker 45 can include a protrusion 91 which allows it to exert, at a specified location, a specific force against the rod 21. Said protrusion can act as a scraper once the capsule 10 is fixed inside the container 1 and once a user removes the pipette 20 from said container 1. By virtue of the protrusion 91, an excess of fluid present on the outer wall of the rod 21 can be removed from said outer wall before the pipette 20 exits the container 1. The sealing grommet 48 can also be provided with a protrusion 92, which allows said sealing grommet 48 to exert a force against the inner wall of the cylindrical body 40.

With reference to FIG. 7, it should be noted that the interior of the body 30 of the lid 3 is provided with an assembly made up of a first push-piece 71 and a second push-piece 72, this second push-piece 72 being longer than the first push-piece 71. The first push-pieces 71 are adapted to come into contact with the stop 44 and to move said stop forward against the edge 11. The second push-pieces 72 are, for their part, adapted to come into contact with the transverse wall 47 in order to displace the assembly made up of the striker 45, the transverse wall 47 and the sealing grommet 48 relative to the cylindrical body 40, during the first mounting of the pipette lid 3 onto the container 1. Thus, the sharp member 46 can perforate the protective cover 60 and release the second fluid 52, allowing mixing between the first fluid 51, which is already present inside the container 1, and the second fluid 52 present in the capsule 10.

Figure 9:
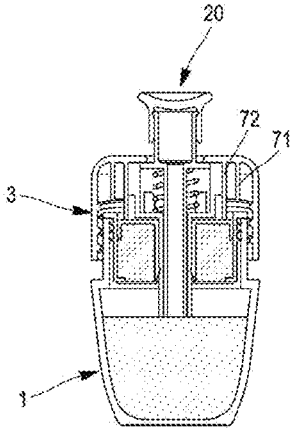
FIG. 9 illustrates a sectional view of the fixing of the pipette lid onto the container, after the capsule is fully inserted inside said container.
Figure 10:
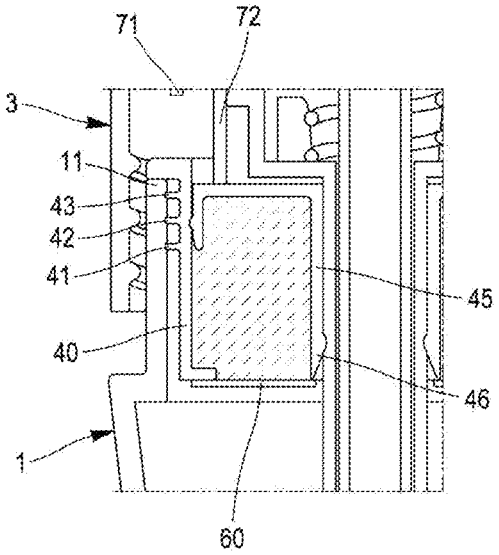
FIG. 10 shows a detailed view of the contact between the upper edge of the container, the body of the pipette lid and the capsule, at the moment when said capsule is inserted inside said container during the fixing of said pipette lid onto the container.

FIG. 9 illustrates the mounting of the container 1 and of the pipette lid 3, at the moment when the capsule 10 has fully entered inside said container 1. As depicted in greater detail in FIG. 10, the capsule 10, which has completely entered inside the container 1, and the three ribs 41, 42, 43 of the cylindrical body 40, have come into contact with the inner wall of said container 1, next to the edge 11. After this first phase, as shown in FIGS. 9 and 10, the user can continue to screw the pipette lid 3 onto the container 1 and, consequently, allow the push-pieces 72 to come into contact with, and exert a force onto, the transverse wall 47. By pushing the transverse wall 47, the striker 45 is also displaced, thus allowing the sharp member 46 to perforate the protective cover 60, as described above.

Figure 11:
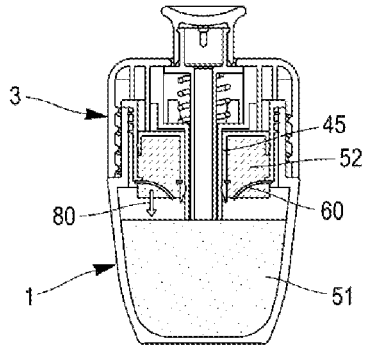
FIG. 11 depicts a diagrammatic view of the mixing between the first fluid contained in the container and the second fluid released from the capsule.

FIG. 11 depicts the conclusion of the first mounting of the pipette lid 3 onto the container 1, just before the first fluid 51 and the second fluid 52 mix. The striker 45 has perforated, with the aid of the sharp member 46, the protective cover 60, thus releasing the second fluid 52. It should be understood that this perforation phase is described diagrammatically, the movement of the second fluid 52 in the direction of the first fluid 51 being indicated with the aid of the arrow 80.

It should be noted that, by virtue of the functioning of the capsule 10 and of the pipette 20, the fluid 52 cannot be expelled from the container 1 without previously being mixed with the fluid 51. Consequently, any risk of direct contact between the fluid 52, in its pure state, and a user's skin is thus avoided.

Figure 12:
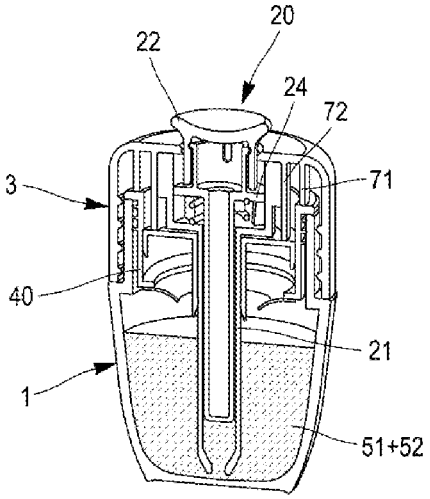
FIG. 12 illustrates a sectional view of the sampling of a specific quantity of fluid performed with the aid of the pipette.

FIG. 12 depicts a diagrammatic view of the sampling of a specific quantity of fluid 51, 52 with the aid of the pipette 20. Pressure is exerted onto the head 22 of the pipette 20 in order to push the plunger 24 in the direction of the base of the container 1. After the step described in FIG. 12, the user can let go of the head 22 again, thus allowing the plunger 24 to take up its initial position again. The movement of the plunger 24 relative to the rod 21 allows a specific quantity of fluid 51, 52 to be sampled towards the interior of the rod 21. After the sampling step, the pipette lid 3 can be removed from the container 1 in order to allow said sample to be returned by pressing on the head 22 of the pipette 20, as shown in FIG. 6.

Figure 13:
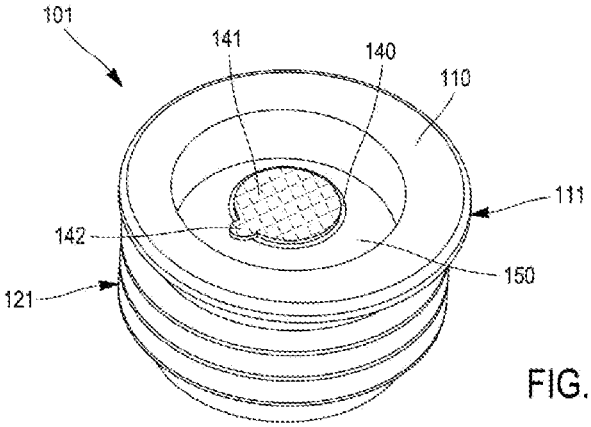
FIG. 13 depicts an embodiment of a capsule according to the invention, in a top view.

FIG. 13 shows a second embodiment of a capsule 101 according to the present invention, which is adapted to be fixed onto the opening in a container, said container itself being adapted to package a first fluid. As explained with reference to FIG. 13, the interior of the capsule 101 is hollow and comprises a space intended for receiving a second fluid.

The capsule 101 is depicted in FIG. 13 in a perspective top view. This indicates that the upper part visible in FIG. 13 remains accessible when said capsule 101 is fixed on the opening in a container.

The capsule 101 comprises an upper wall 110, provided with an edge 111, the two being adapted to cooperate with the container on which said capsule 101 is fixed. The edge 111 has a diameter which is essentially similar to the diameter of the opening in the container on which the capsule 101 is fixed. This is depicted more clearly in FIG. 15.

Figure 14:
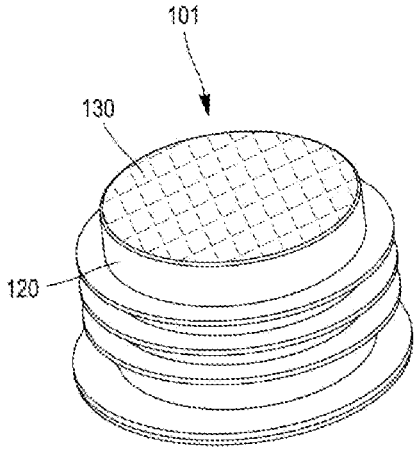
FIG. 14 shows the capsule according to FIG. 1, in a bottom view.

The capsule 101 has a longitudinal wall 120 which is depicted in FIG. 14. Fixing structures 121 are present on said longitudinal wall 120. According to the example, as depicted in FIG. 13, said fixing structures 121 present on the capsule 101 have the form of circumferential members present on the exterior of the longitudinal wall 120.

The fixing structures 121 have the special characteristic of deforming, partially elastically, so that the end of the circumferential members exerts a certain force onto the interior of the opening in the container onto which the capsule 101 has been fitted, in order to ensure leaktightness at the end of the fixing structures 121 and inside the opening in said container on which the capsule 101 is fixed.

According to an alternative embodiment (not shown in the figures), the fixing structures 121 can, for example, be in the form of a thread which makes it possible to cooperate with fixing structures present in the opening in a container.

The upper wall 110 is provided with a recess in which the upper part of a striker 140, which has an essentially cylindrical form, is visible. The form of the striker 140 is more clearly depicted in FIG. 15. The upper end of the striker 140 is sealed with the aid of a protective cover 141 provided with a tongue 142, which facilitates the removal of said protective cover 141 by the user.

The protective cover 141 comprises a material, or an assembly of materials, specifically adapted to protect the second fluid inside the capsule 101. This or these material(s) is or are particularly adapted to avoid the second fluid coming into contact with oxygen. Aluminum is a material particularly adapted to the manufacture of the protective cover 141.

As depicted in FIG. 13, the striker 140 is fixed, close to its upper end, onto a wall 150 made of a flexible material. In the present description, the term "flexible material" indicates that the wall 150 is adapted to be deformed to allow the striker 140 to be displaced from a first to a second position and to allow the storage of a specific quantity of energy, which allows said striker to return to its initial position without altering the integrity of said wall 150.

Figure 15:
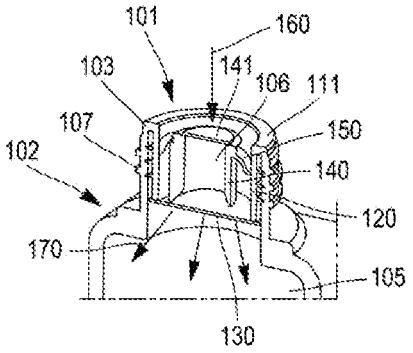
FIG. 15 depicts a sectional view of an assembly made up of a container and a capsule fixed on the outlet orifice of said container.

FIG. 14 depicts a perspective view of the capsule 101 according to FIG. 13, its lower end being directed upwards. FIG. 14 shows that the lower end of the capsule 101 is sealed with the aid of a protective cover 130. As depicted in detail in FIG. 15, said protective cover 130 is adapted to seal an interior space inside said capsule 101, this space being adapted to receive a second fluid. The protective cover 130 is also adapted to cooperate with the striker 140 and can be perforated by said striker 140 once this is displaced from a first starting position to a second opening position. FIG. 15 depicts, in a more detailed manner, the cooperation between the striker 140 and the protective cover 130.

FIG. 15 shows the fixing and use of the capsule 101 present inside a container 102. A certain force is exerted onto the capsule 101 to fix said capsule 101 in the head 103 of the container 102. When the capsule 101 is fixed, its edge 111 is positioned on the upper end of the head 103 of said container 102.

FIG. 15 diagrammatically depicts the at least partially deformed position of the fixing structures 121, said position allowing said fixing structures 121 to leaktightly seal the space between the exterior of the capsule 101 and the interior of the head of the container 102.

The container 102 is provided, within it, with a space 105 intended for receiving a first fluid. The capsule 101 is also provided with an inner space 106 adapted to receive a second fluid. For the obvious sake of clarity, the first fluid and the second fluid are not depicted in FIG. 15. The space 106, present inside the capsule 101, is delimited by an assembly made up of the wall made of flexible material 150, the upper protective cover 141, the longitudinal wall 120 of the capsule 101 and the protective cover 130. As shown in FIG. 15, the striker 140 is provided, at its lower end, with a sharp edge.

The protective cover 130 preferably has the same capacity to protect the second fluid as the protective cover 141 described above.

The functionalities of the capsule 101, as depicted in FIGS. 13, 14 and 15, are as follows.

The container 102 provided with a capsule 101 can, before its first use, be sealed with the aid of a lid (not shown in FIG. 15). A lid of this type can, for example, be fixed onto a thread 107 present on the exterior of the head 103 of the container 102. During first use, the user removes the lid in order to access the upper part of the capsule 101. As depicted with the aid of the arrow 160, the user can exert a certain pressure onto the upper part of the striker 140 using his/her finger. This indicates that the user exerts a push onto the striker 140 at the protective cover 141. By virtue of the presence of a wall made of flexible material 150, the striker 140 can be displaced from the position as shown in FIG. 15 in the direction of the protective cover 130. The user displaces the striker 140 until the protective cover 130 is pierced by the sharp edge of said striker 140. When said protective cover 130 is pierced, the second fluid present within the capsule 101 is released and can flow within the space 105 and mix with the first fluid which is already present within said space 105. The release of the second fluid towards the space 105 is depicted diagrammatically with the aid of the arrows 170, which are visible in FIG. 15.

Once the first fluid and the second fluid have been mixed, as described in the paragraph above, the container 102 can be shaken in order to achieve an optimal mixing of the two fluids. During this mixing action, and by virtue of the presence of the protective cover 141 sealing the upper part of the striker 140, there is no risk of leakage of said mixture in the container 102.

Figure 16:
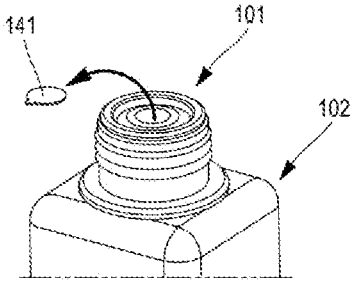
FIG. 16 illustrates the moment when the outer protective cover is removed.

In order to release the mixture of the two fluids present in the container 102, a following step consists of removing the protective cover 141. This is depicted in FIG. 16. When the protective cover 141 is removed, the upper end of the striker 140 is accessible to the user so that he/she can access the interior of the container 102. Since the striker 140 substantially has a cylindrical form, this becomes, in a following step, a guide for an extraction device such as a pipette. The use of such a pipette is depicted in FIG. 17.

According to an alternative embodiment (not shown in the figures), the protective cover 141 can be adapted to be perforated with the aid of an extraction device.

Figure 17:
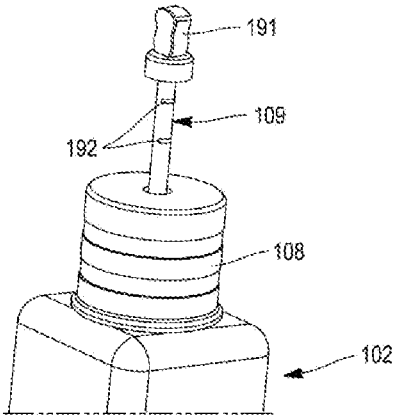
FIG. 17 depicts the introduction of a gradated sampling pipette towards the interior of the container.

According to the example in FIG. 17, a lid 108 is positioned on the outer end of the head 103 of the container 102. The lid 108 seals the upper end of said container 102 and serves to guide a pipette 109 from the exterior to the interior of the container 102. The pipette 109 is guided, with the aid of the lid 108 and the striker 140, from the exterior of the container 102 to the interior in order to come into contact with the mixture of the fluids present inside the space 105 of the container 102. The pipette 109 is provided with a head 191 which, according to one embodiment, can be made of a flexible material. Said flexible material allows the user to deform said head 191 in order to aspirate and extract a certain quantity of the fluid present inside said pipette 109.

The pipette 109 can be provided with a marking 192 which allows a specific sampling in line with one of the gradations of said marking 192. When a specific quantity of fluid is extracted from the container 102 with the aid of the pipette 109, said pipette can be repositioned in the lid 108, thus sealing the upper end of the assembly of the container 102 and the lid 108 and making it possible to avoid the contents of said container 102 coming into contact with the ambient air.

According to an alternative embodiment, not depicted in FIG. 17, the upper part of the lid 108 and the lower part of the head 191 of the pipette 109 can be provided with a "bayonet"-type system which allows said pipette 109 to be fixed in a defined position relative to the lid 108.

The invention claimed is:

1. An assembly comprising a container, adapted to contain a first fluid, with an opening which allows the container to be filled and emptied, a lid adapted to seal the opening and a capsule to seal an opening in a container, wherein the container is adapted to contain a first fluid, the capsule being adapted to contain a second fluid that is different from the first fluid, the capsule comprising a striker which is movable from a first initial position to a second opening position and which, in the second opening position, allows the second fluid to be released into the container, thus mixing the first fluid and the second fluid, the striker being in a form of an open cylinder adapted to allow a fluid sampling device to pass through the capsule and to enter the container, wherein the capsule, in a use position of the capsule, at a side exposed towards an interior of the container, is defined by a first protective cover, a lower part of said striker being provided with a sharp end adapted to perforate the protective cover, wherein the container comprises fixing structures which allow the lid to be fixed onto the container, wherein an interior of the lid comprises at least one first push-piece adapted to push the capsule towards an interior of the opening in the container, thus fixing the capsule in the opening and wherein the interior of the lid comprises at least one second push-piece adapted to cooperate with a transverse wall of the striker, thus allowing the striker to be moved forward from its first initial position to its second opening position.

2. The capsule according to claim 1, wherein the capsule comprises fixing structures for fixing the capsule in the opening in the container.

3. The capsule according to claim 1, wherein the first protective cover comprises a material which is impermeable to oxygen.

* * * * *